US007764195B2

(12) United States Patent
Glover

(10) Patent No.: US 7,764,195 B2
(45) Date of Patent: Jul. 27, 2010

(54) THREE-ARROW LED TRAFFIC SIGNAL SYSTEM

(76) Inventor: Benjamin A. Glover, 1607 Fieldgreen Overlook, Stone Montain, GA (US) 30088

( * ) Notice: Subject to any disclaimer, the term of this patent is extended or adjusted under 35 U.S.C. 154(b) by 280 days.

(21) Appl. No.: 12/099,808

(22) Filed: Apr. 9, 2008

(65) Prior Publication Data

US 2009/0256720 A1 Oct. 15, 2009

(51) Int. Cl.
*G08G 1/095* (2006.01)

(52) U.S. Cl. ..... 340/907

(58) Field of Classification Search ..... 340/907, 340/815.67, 815.65, 931; 362/227; 345/82
See application file for complete search history.

(56) References Cited

U.S. PATENT DOCUMENTS 5,898,381 A * 4/1999 Gartner et al. ..... 340/815.65
6,036,336 A 3/2000 Wu
6,144,311 A * 11/2000 Hahn et al. ..... 340/815.45
6,567,010 B1 * 5/2003 Lin et al. ..... 340/815.67
7,006,011 B1 * 2/2006 Colby ..... 340/907
7,281,819 B2 10/2007 Hsieh et al.
2004/0008126 A1 1/2004 Diba et al.

* cited by examiner

*Primary Examiner*—Phung Nguyen
(74) *Attorney, Agent, or Firm*—Louis Ventre, Jr.

(57) ABSTRACT

A traffic signal system has a main housing unit that encloses three nested arrow signals pointed towards the top, namely, a red arrow signal, a yellow arrow signal nested within the red arrow signal, and a green arrow signal nested within the yellow arrow signal. Each arrow signal is made with a plurality of LEDs. A smaller satellite housing unit, preferably one-third to two-thirds the height, is attachable to the main housing unit to provide a left or right turn signal also comprised of three nested arrow signals. Arrow signals are preferably removably installed. A removable cover provides access to the back of the three arrow signals. Both housing units are preferably waterproof and have hinged closures. An electrical terminal block provides for electrical connections. Removable visors shade the light from the LEDs. Water drain knockouts to the visor and housing units facilitate water removal.

17 Claims, 3 Drawing Sheets

THREE-ARROW LED TRAFFIC SIGNAL SYSTEM

FIELD OF INVENTION

In the field of traffic control indicators, a signal system is disclosed incorporating energy efficient LED lighting in a modular configuration that is installable in diverse conditions found for such signals and that is friendly to color blind drivers and pedestrians.

BACKGROUND OF THE INVENTION

The invention provides nested lighting for traffic control that is more easily recognizable by drivers and clarifies through its colors and its distinctive display the desired vehicle movements at traffic signal intersections. The invention adds a dimension of shape to the typical colors that control movement. It is an improvement that allows it to be implemented within the operational framework of current devices, having color and signal purposes that are consistent with today's devices.

Preferred embodiments of the nested-lighting signal system of the present invention are shorter in overall height to minimize damage from tall trucks and extended height trailer loads when compared to 8-inch or 12-inch, 3-head conventional signal systems currently in use.

Preferred embodiments of the nested-lighting signal system of the present invention are lighter in weight to better facilitate handling by repair technicians and to enable a less stringent maintenance and construction support effort.

The nested-lighting signal system of the present invention is modular in construction to minimize costs relating to high volume maintenance and storage.

The nested-lighting signal system of the present invention is flexible in use to allow more operational applications.

Preferred embodiments of the nested-lighting signal system of the present invention are longer in service life to minimize life-cycle maintenance costs.

DESCRIPTION OF PRIOR ART

The use of Light Emitting Diodes (LEDs) in traffic lights is known. For example, U.S. Pat. No. 7,281,819 discloses an LED traffic light structure that includes an LED light source having a circuit board and multiple LEDs. The present invention is different in that it employs nested LED-arrayed lights in a modular arrangement that adds versatility to installation options.

LEDs are also used in the traditional red, yellow and green circular configuration to create arrows for traffic movement. For example, U.S. Pat. No. 6,567,010 ("the '010 patent) is for a traffic signal head with a plurality of LED light sources mounted in a circular arrangement. The LEDs are identical three-color LED light sources and capable of forming an arrow by selective lighting of the circular arrangement of LEDs. The present invention is an improvement over the '010 patent disclosure in that the shape and location of the arrow is different for each driver control instruction, providing a means for a visually impaired driver to determine the meaning of the signal by the shape and location of the arrow.

Finally, the use of arrow or chevron shaped LEDs is described in the prior art. For example, U.S. Pat. No. 6,036,336 is for a light emitting diode retrofit lamp with locking swivel mount that mounts into a threaded screw-in electrical socket of a traffic signal. Arrow signals are presently used in traffic control to indicate an authorized turn that may be made.

The present invention is different in that it is a nested system of LEDs that replaces the traditional circular red, yellow and green housing and lamps. It is not a screw-in system, but a new system with the same color scheme but having the advantage of providing a shape variation that is easily recognized by the visually impaired.

The present invention improves the state of the art by providing a nested arrow signal traffic system that will require fewer individual signal units when employed in selected applications; may help minimize damage from tall trucks and extended height trailer loads; will enable less costly maintenance and construction support effort due to lower overall weight of the system; will ease maintenance requirements due to the modularity of the nested arrows; will lower replacement costs because LED signals last longer before failures and do not typically fail as a unit; and will be friendly to color blind drivers and pedestrians due to the different size and arrangement of the nested arrow signals.

BRIEF SUMMARY OF THE INVENTION

A traffic signal system has a main housing unit similar in size to existing traffic lights. It encloses three nested arrow signals pointed towards the top, namely, a red arrow signal, a yellow arrow signal nested within the red arrow signal, and a green arrow signal nested within the yellow arrow signal. Each arrow signal is made with a plurality of LEDs placed in a configuration such that one of the three arrow signals is lighted when the traffic signal is activated. A smaller satellite housing unit, preferably one-third to two-thirds the height, is attachable to the main housing unit to provide a left or right turn signal, and it also encloses three similar but not necessarily identical nested arrow signals. Each of the three arrow signals is preferably removably installed. Each color is preferably provided by single color LEDs. A removable cover provides access to the back of the three arrow signals. Both housing units are preferably waterproof and have hinged closures. An electrical terminal block in the main housing unit provides for easy electrical connection. Visors, secured by removable screws, are attachable to each unit to shade the light from the LEDs. Water drain knockouts to the visor and housing units facilitate water removal.

BRIEF DESCRIPTION OF THE DRAWINGS

The reference numbers in the drawings are used consistently throughout. New reference numbers in FIG. 2 are given 200 series numbers. New reference numbers in FIG. 3 are given 300 series numbers. New reference numbers in FIG. 4 are given 400 series numbers.

DETAILED DESCRIPTION

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural and operational changes may be made without departing from the scope of the present invention.

Figure 1:
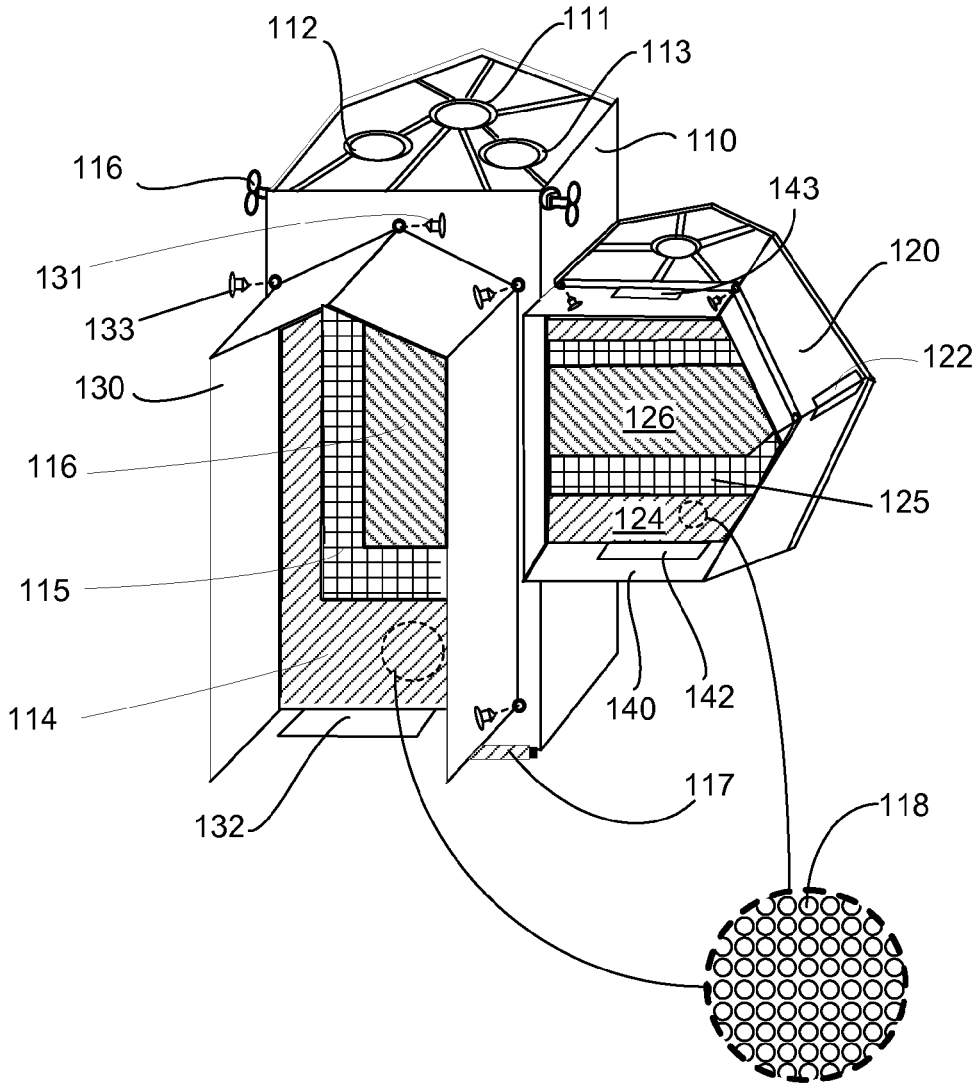
FIG. 1 is a perspective of a preferred embodiment of a traffic signal system according to the invention.

FIG. 1 is a perspective of a preferred embodiment of a traffic signal system according to the invention. The traffic signal system comprises a main housing unit (110) having a front, top, bottom, left side and right side. The main housing unit encloses three arrow signals pointed towards the top, the three arrow signals comprising a red arrow signal (114), a yellow arrow signal (115) nested within the red arrow signal (114), and a green arrow signal (116) nested within the yellow arrow signal (115).

The color, luminous intensity and coverage, and chromaticity of the three arrow signals preferably meet or exceed standards found in the Manual of Uniform Traffic Control Devices (MUTCD) and the Institute of Transportation Engineers Vehicle Traffic Control Signal Heads (ITE VTCSH of Jun. 27, 2005). Electrical power requirements for all LED lamps are preferably 120 volts, 60 Hz, and compatible with power requirements of existing traffic signal devices.

Each arrow signal (114, 115 and 116) is made with a plurality of LEDs (118), also known as Light Emitting Diodes. When the context so permits the term "LED" as it relates to these arrows is intended to describe this plurality of individual LEDs. Each arrow signal is removably installed in the unit so that it can be easily replaced if necessary for maintenance. The dotted circle in FIG. 1 is intended to represent a magnification of a typical LED arrow signal portion. The LEDs are placed in a configuration such that one of the three arrow signals is lighted when the traffic signal is activated. Each LED is preferably removably installed in the configuration. Also, each LED is preferably a single color LED.

While the invention may be made in any size, a preferred embodiment offers potential cost savings in installation due to reduced overall weight in comparison to a standard three-section head traffic signal housing. The main housing unit (110) generally is the approximate size of conventional three-section traffic signal housing units to minimize confusion by motorists. Preferably, the width of main housing unit (110) is a little wider and is overall shorter in height than a standard three-section head traffic signal housing. The main housing unit (110) is preferably about 33 inches from top to bottom, about 16 inches wide (from left side to right side) and about 6 inches deep.

Having a shorter height to the main housing unit (110) in comparison to a standard three-section head traffic signal housing is a desired feature since a shorter profile is more of an advantage in that the shorter height would reduce the likelihood of the units being hit by trucks passing underneath.

Overall size and total light surface of the individual lights can be important to a preferred embodiment of the invention. Preferably, the light surface area of each of the invention's signal lights is the same or greater than the light surface area of each of the conventional circular lights in existing traffic signal units. This is to ensure each of the LED signal lights has the same or greater visibility as the corresponding circular signal lights in existing traffic signal units.

Figure 2:
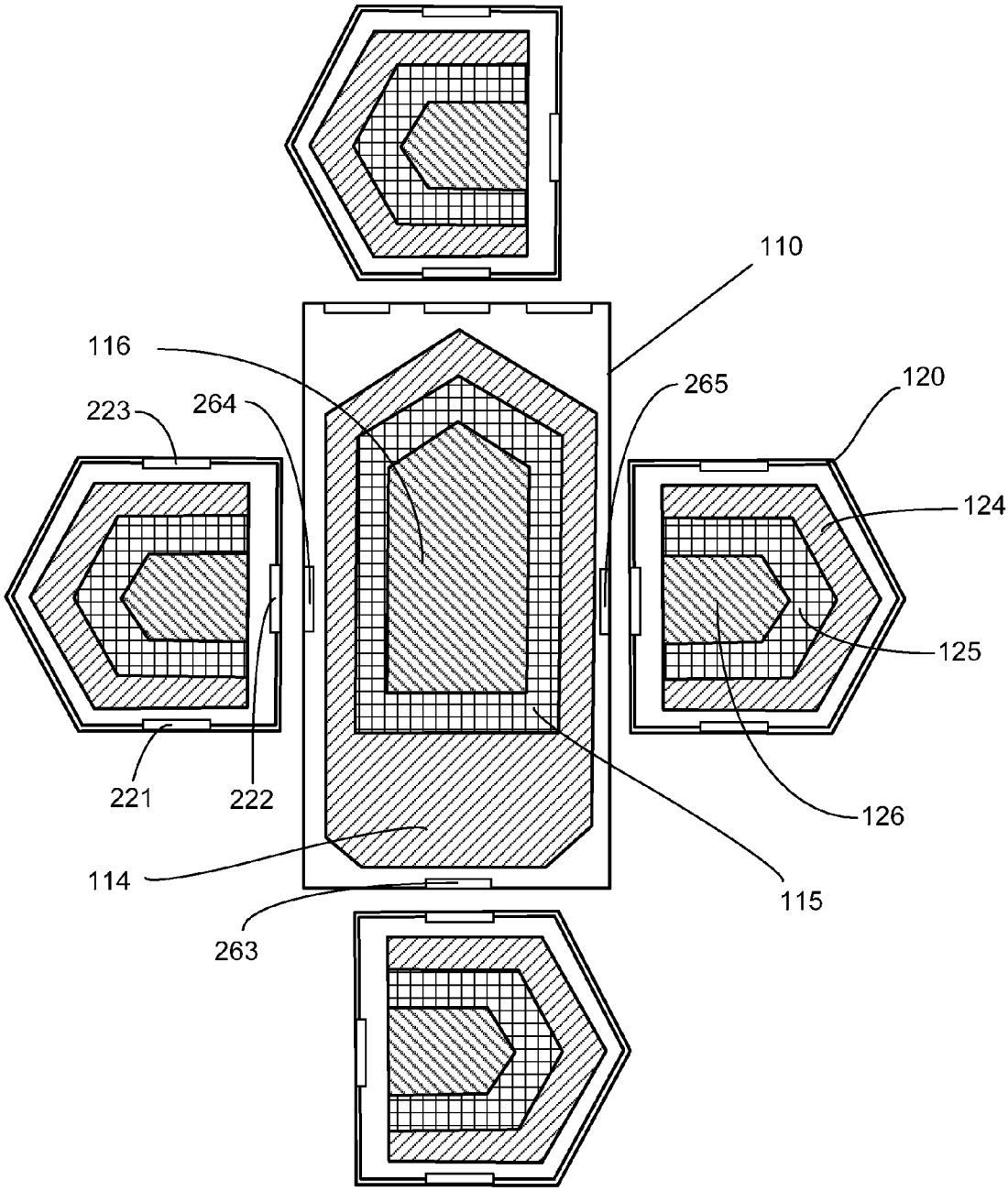
FIG. 2 is a front view of a main housing unit and four satellite housing units.

Preferably, the main housing unit (110) has: a red signal light (114) that is about 32 inches tall and about 15 inches wide with about a 2 inch wide frame around the inner nested yellow signal light (115); a yellow signal light (115) that is about 22 inches tall and about 10 inches wide with about 2 inch wide frame around the inner nested green signal light (116); and a green signal light (116) that is about 18 inches tall and about 6 inches wide. As shown in FIG. 2 the green signal light (116) is preferably in the shape of a bar type arrow, since it has no inner nested signal light.

The traffic signal system may also comprise a satellite housing unit (120) having a front, top, bottom, left side and right side. The satellite housing unit (120) is smaller than the main housing unit (120) in height measured from top to bottom. Preferably, the satellite housing unit (120) is between one-third and two-thirds of the height of the main housing unit (110), and more preferably, the satellite housing unit (120) is about 16 inches from top to bottom about 16 inches wide (from left side to right side) and about 6 inches deep.

The satellite housing unit (120) encloses three arrow signals pointed towards the top comprising a red arrow signal (124), a yellow arrow signal nested (125) within the red arrow signal (124), and a green arrow signal (126) nested within the yellow arrow signal (124). The three arrows (124, 125 and 126) are preferably truncated versions of the three arrows (114, 115, and 116) in the main housing unit (110), preferably having a shorter tail end than those in the main housing unit. The arrows may be of different design, for example as shown in FIG. 2, the main housing unit (110) red arrow signal (124) and yellow arrow signal (124) are shown with a connector at the bottom or tail end of the arrow and corresponding arrows (124 and 125) in the satellite housing unit (120) are shown without the connector.

In a preferred embodiment, the main housing unit (110) has: a red signal light (124) that is about 15 inches tall with about a 2-inch wide frame around the inner nested yellow signal light (125); a yellow signal light (125) that is about 13 inches tall with about a 2-inch wide frame around the inner nested green signal light (126); and a green signal light (126) that is about 11 inches tall and about 6 inches wide. As shown in FIG. 2 the green signal light (126) is preferably in the shape of a bar type arrow, and the red signal light (124) and yellow signal light (125) have no connector at the bottom.

In the satellite housing unit (120), similarly to the main housing unit (110), each arrow signal (124, 125 and 126) is made with a plurality of LEDs (118) which are placed in a configuration such that one of the three arrow signals is lighted when the traffic signal is activated.

In preferred embodiments, the satellite housing unit (120) is attached to one of the top, bottom, left side and right side of the main housing unit. FIG. 1 shows a satellite housing unit (120) attached to the right side of the main housing unit (110) and FIG. 4 generally shows the four possible satellite housing unit (120) attachment locations in reference to the main housing unit (110). Typically, a satellite housing unit (120) would be used when a left or right turn signal, or left and right turn signals, are desired at an intersection.

Alternatively, in some embodiments, the satellite housing unit (120) is employed alone and independently of the main housing unit (110), for example on a pole at the right side of the road to indicate right-turn control.

Preferably, the traffic signal system has a means to attach that permits assembly and disassembly of a satellite housing unit (120) to a main housing unit (110) as desired for an intersection location. In referring to FIGS. 1 and 2, it may be seen that the means to attach preferably comprises: a plurality of top knockouts, more preferably three top knockouts (111, 112 and 113), across the top of the main housing unit; a bottom knockout (263) on the main housing unit (110), a left-side knockout (264) on the main housing unit (110); and a right-side knockout (265) on the main housing unit. Preferably, knockouts are industry standard, serrated-edge knockouts.

Preferably, the means to attach further comprises a bottom knockout on the satellite housing unit (222), left-side knockout on the satellite housing unit (221); and right-side knockout (223) of the satellite housing unit.

The three knockouts on the top of the main housing unit (110) form a top-left knockout (112), a top-center knockout (111) and a top-right knockout (113). These three top knockouts enable a balanced installation of satellite housing units (120) when one, two or three satellite housing units are attached to the main housing unit (110). A first example is a first satellite housing unit (120) connected through the top-center knockout (111) balances the traffic signal to hang approximately vertically when the traffic signal is made operable with only that first satellite housing unit (120), and also when two additional satellite housing units are connected through the both the right-side knockout (265) and left-side knockout (264) on the main housing unit (110).

A second example is a first satellite housing unit (120) connected through the top-left knockout (112) balances the traffic signal having a second satellite housing unit (120) attached through the right-side knockout (265) of the main housing unit (110) such that the traffic signal hangs approximately vertically when the traffic signal is made operable.

A third example is a first satellite housing unit (120) connected through the top-right knockout (113) balances the traffic signal having a second satellite housing unit (120) attached through the left-side knockout (264) of the main housing unit (110) such that the traffic signal hangs approximately vertically when the traffic signal is made operable.

The three arrow signals in each of the main housing unit (110) and the satellite housing unit (120) are preferably held in an installed position by a removable cover (450) and (350), respectively, which when removed allows access to the back of the three arrow signals.

The main housing unit (110) and the satellite housing unit (120) are preferably waterproof.

Figure 3:
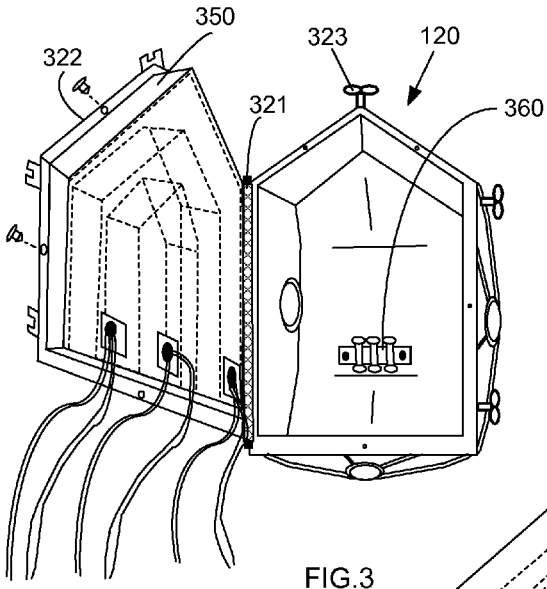
FIG. 3 is a perspective of a satellite housing unit with an open hinged closure.
Figure 4:
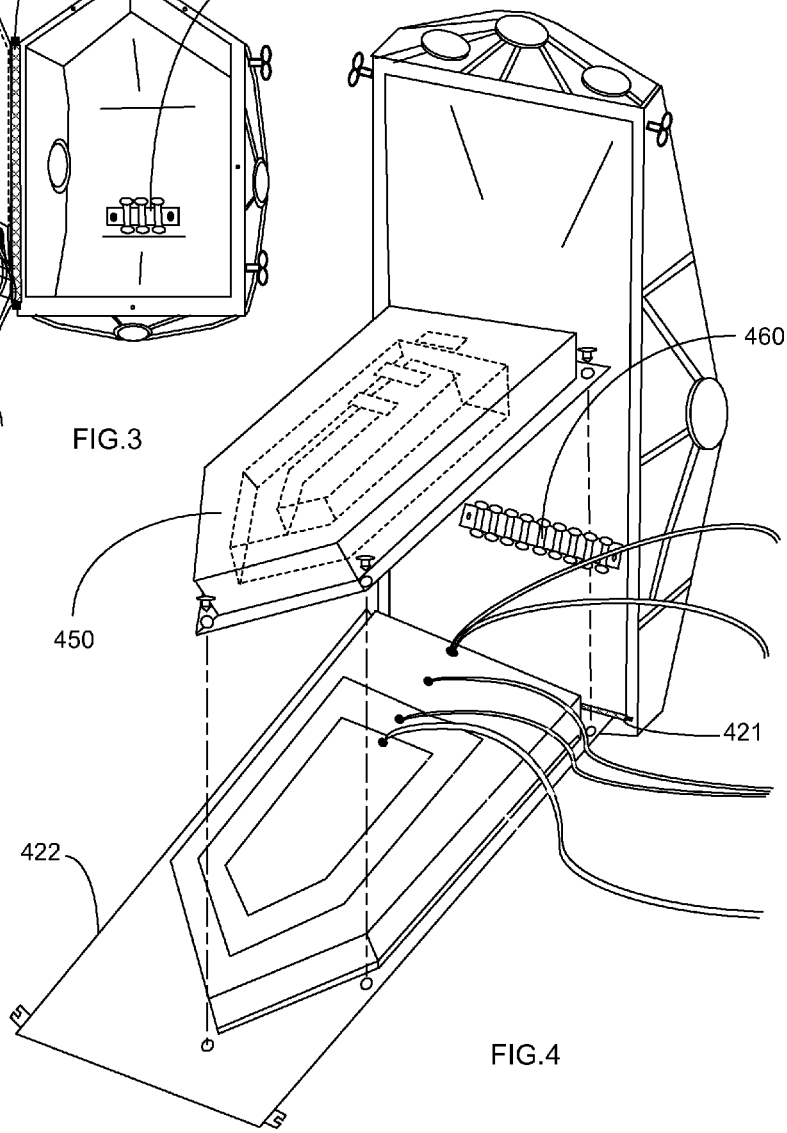
FIG. 4 is a perspective of a main housing unit with an open hinged closure.

FIGS. 3 and 4 show perspectives of main housing unit (110) and the satellite housing unit (120) with a preferred hinged closure (422). The hinged closure (422) for the main housing unit has a hinge (421) at the bottom to allow the front of the main housing unit (110) to be opened from the top down. The hinged closure (322) for the satellite housing unit (120) has a hinge (321) on the left side. A typical thumb screw (323) may be used for securing the hinged closure on the satellite housing unit (120) and similar thumb screws may be used for the main housing unit (110).

An electrical terminal block (460) is preferably included in the main housing unit to simplify the installation of electrical connections to the traffic signal system. The terminal block (460) preferably has a minimum of nine pairs of electrical connections and is preferably removable to facilitate a variety of installation setups for satellite housing units (120).

Similarly, an electrical terminal block (360) is preferably included in the satellite housing unit (120) to simplify the installation of electrical connections to the traffic signal system. The terminal block (360) preferably has a minimum of three pairs of electrical connections to facilitate electrical connections with the arrow signals in the satellite housing unit and is preferably removable.

A visor (130) may be installed for the three arrow signals in the main housing unit (110) and a visor (140) may be installed for the three arrow signals in the satellite housing unit (120). The visors (130) and (140) are preferably installed by removable screws (133). The visors may fully encircle the three arrow signals or may be confined to a portion of the perimeter of the three arrow signals. A water drain knockout is preferably provided when the visor fully encircles the three arrow signals. The function of each visor is to shade the three arrow signals.

Water drain knockouts are also preferably installed on the main housing unit (110) and the satellite housing unit (120), including a bottom drain knockout (132) on the main housing unit (110); and on the satellite housing unit (120), a top drain knockout (122), a right-side drain knockout (142), and a left-side drain knockout (143).

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A traffic signal system comprising:

a main housing unit having a front, top, bottom, left side and right side, wherein the main housing unit encloses three arrow signals pointed towards the top, the three arrow signals comprising a red arrow signal, a yellow arrow signal nested within the red arrow signal, and a green arrow signal nested within the yellow arrow signal, wherein each arrow signal is made with a plurality of LEDs placed in a configuration such that one of the three arrow signals is lighted when the traffic signal is activated; and, a satellite housing unit having a front, top, bottom, left side and right side, wherein the satellite housing unit is smaller than the main housing unit in height measured from top to bottom, wherein the satellite housing unit encloses three arrow signals pointed towards the top comprising a red arrow signal, a yellow arrow signal nested within the red arrow signal, and a green arrow signal nested within the yellow arrow signal, wherein each arrow signal is made with a plurality of LEDs placed in a configuration such that one of the three arrow signals is produced when activated, wherein said satellite housing unit is attached to one of the top, bottom, left side and right side of the main housing unit.

2. The traffic signal system of claim 1 further comprising a means to attach the satellite housing unit to the main housing unit, wherein the means to attach comprises:

a plurality of top knockouts across the top of the main housing unit;

a bottom knockout, left-side knockout, and right-side knockout on the main housing unit; and, a bottom knockout, left-side knockout, and right-side knockout on the satellite housing unit.

3. The traffic signal system of claim 2 comprising three knockouts placed across the top of the main housing unit forming a top-left knockout, a top-center knockout and a top-right knockout such that a satellite housing unit connected through the top-center knockout balances the traffic signal to hang approximately vertically when the traffic signal is made operable;

a satellite housing unit connected through the top-left knockout balances the traffic signal having a second satellite housing unit attached through the right-side knockout of the main housing unit such that the traffic signal hangs approximately vertically when the traffic signal is made operable; and, a satellite housing unit connected through the top-right knockout balances the traffic signal having a second satellite housing unit attached through the left-side knockout of the main housing unit such that the traffic signal hangs approximately vertically when the traffic signal is made operable.

4. The traffic signal system of claim 1 wherein the satellite housing unit is between one-third and two-thirds the height of the main housing unit.

5. The traffic signal system of claim 1 wherein an arrow signal is removably installed.

6. The traffic signal system of claim 1 wherein an LED is a single color LED.

7. The traffic signal system of claim 1 wherein the three arrow signals are held in an installed position by a removable cover which when removed allows access to the back of the three arrow signals.

8. The traffic signal system of claim 1 wherein the main housing unit and the satellite housing unit are waterproof.

9. The traffic signal system of claim 1 further comprising a plurality of hinged closures, wherein a hinged closure for the main housing unit is hinged at the bottom to allow the front of the main housing unit to be opened from the top down and wherein a hinged closure for the satellite housing unit is hinged on the left side.

10. The traffic signal system of claim 1 further comprising an electrical terminal block in the main housing unit.

11. The traffic signal system of claim 10 wherein the terminal block comprises nine pairs of electrical connections.

12. The traffic signal system of claim 1 further comprising an electrical terminal block in the satellite housing unit.

13. The traffic signal system of claim 12 wherein the terminal block comprises three pairs of electrical connections.

14. The traffic signal system of claim 1 further comprising a plurality of visors wherein a visor shades the three arrow signals of the main housing unit and a visor shades the three arrow signals of the satellite housing unit.

15. The traffic signal system of claim 14 wherein each visor is secured by removable screws.

16. The traffic signal system of claim 14 wherein each visor surrounds arrow signals and comprises a water drain knockout.

17. The traffic signal system of claim 1 further comprising a plurality of water drain knockouts, wherein a water drain knockout is located on the bottom of the main housing unit and a water drain knockout is located on the top, right side, and left side of the satellite housing unit.

* * * * *